US006036450A

United States Patent [19]

Murayama

[11] Patent Number: 6,036,450

[45] Date of Patent: Mar. 14, 2000

[54] VARIABLE CAPACITY VANE COMPRESSOR

[75] Inventor: Toshihiro Murayama, Higashimatsuyama, Japan

[73] Assignee: Zexel Corporation, Tokyo, Japan

[21] Appl. No.: 09/050,383

[22] Filed: Mar. 30, 1998

[30] Foreign Application Priority Data

Apr. 4, 1997 [JP] Japan ..... 9-102791

[51] Int. Cl.[7] ..... F04B 49/24; F04C 29/10

[52] U.S. Cl. ..... 417/295; 417/309; 417/310

[58] Field of Search ..... 417/309, 310, 417/440, 441, 298, 295

[56] References Cited

U.S. PATENT DOCUMENTS

| | | | |
|---|---|---|---|
| 4,447,196 | 5/1984 | Nagasaku et al. | 418/93 |
| 5,020,976 | 6/1991 | Nakajima et al. | 417/295 |
| 5,051,070 | 9/1991 | Kazaoka et al. | 417/295 |
| 5,125,804 | 6/1992 | Akaike et al. | 417/295 |
| 5,505,592 | 4/1996 | Kumagai et al. | 417/213 |
| 5,860,797 | 1/1999 | Fujimura et al. | 417/440 |

FOREIGN PATENT DOCUMENTS 7-247982 9/1995 Japan .

*Primary Examiner*—David J. Torrente

*Attorney, Agent, or Firm*—Frishauf, Holtz, Goodman, Langer & Chick, P.C.

[57] ABSTRACT

A variable capacity vane compressor includes side members secured to opposite end faces of a cylinder block, respectively, and a rotary plate mounted in one of the side members, for adjusting compression starting timing of the compressor to thereby increase or decrease capacity or delivery quantity of the compressor. Further, the compressor includes a main piston slidably mounted in the one of the side members, for causing rotation of the rotary plate, a pilot piston slidably arranged at one end of the main piston, for inhibiting movement of the main piston in a capacity-decreasing direction, a first low-pressure chamber formed within another end portion of the main piston, into which suction pressure is introduced via a first low-pressure communication passage, a high-pressure chamber defined by a reduced-diameter portion formed on the one end of the main piston and one end face of the pilot piston, into which is introduced control pressure for driving the main piston and the pilot piston, a second low-pressure chamber formed at another end of the pilot piston, into which suction pressure is introduced via a second low-pressure communication passage, a main urging member urging the main piston in the capacity-decreasing direction, and an auxiliary urging member urging the main piston in a capacity-increasing direction. The second low-pressure communication passage has a cross-sectional area which is smaller than a cross-sectional area of the first low-pressure communication passage.

7 Claims, 8 Drawing Sheets

VARIABLE CAPACITY VANE COMPRESSOR

BACKGROUND OF THE INVENTION

1. Field of the Invention

This invention relates to a variable capacity vane compressor having a construction which Is capable of changing the capacity or delivery quantity of the compressor.

2. Description of the Prior Art

A conventional variable capacity vane compressor includes a cylinder block, a rotor rotatably received in the cylinder block, a plurality of vanes each of which is radially slidably fitted in an axial vane slit formed in the rotor, two side blocks secured to opposite end faces of the cylinder block, respectively, a rotary plate received in a recess formed in one of the side blocks, in a manner rotatable between a partially operating position for minimizing delivery quantity of the compressor and a fully operating position for maximizing the delivery quantity of the same, and a piston which causes rotation of the rotary plate (Japanese Laid-Open Patent Publication (Kokai) No. 7-247982).

FIG. 1 is a longitudinal cross-sectional view showing the piston within the conventional compressor.

The piston 132 is slidably received in a cylinder bore 105*c*, for causing rotation of the rotary plate, not shown, via a link pin 131 fixed to the rotary plate.

The link pin 131, which is protruded toward a rear side of the compressor, has an end thereof partially fitted in an annular groove 132*a* formed in a peripheral surface of the piston 132, and partially fitted in an arcuate guide groove, not shown, formed in the rear side block 105, in a manner slidable along the guide groove. As the piston 132 reciprocates within the cylinder bore 105*c*, the end of the link pin 131 slides along the arcuate guide groove to cause rotation of the rotary plate.

A spring guide member 133 having a rod-shaped spring guide portion 133*a* is inserted into one end portion of the cylinder bore 105*c*. One end of the cylinder bore 105*c* is closed tightly by a spring seat 133*b* of the spring guide member 133 and an O ring 134. The spring seat 133*b* is fixed to the rear side block 105 by a pin 135. On the other hand, another end of the cylinder bore 105*c* is closed tightly by a plug 136 and an O ring 137. The plug 136 is fixed to the rear side block 105 by a pin 138.

The piston 132 has one end thereof formed with a low-pressure chamber 139 into which suction pressure Ps within a suction chamber is introduced. Another end of the piston 132 and the plug 136 define a high-pressure chamber 140 into which control pressure Pc (Pc≧Ps) is introduced. The piston 132 is urged toward the partially operating position (leftward as viewed in FIG. 1) for minimizing the delivery quantity of the compressor, by a spring 141 interposed between a bottom surface of a bore 139*a* formed in the piston 132 and the spring seat 133*b* of the spring guide member 133 and the suction pressure Ps within the low-pressure chamber 139. At the same time, the piston 132 is urged by the control pressure Pc within the high-pressure chamber 140 toward the fully operating position (rightward as viewed in FIG. 1) for maximizing the delivery quantity of the compressor. Therefore, the piston 132 reciprocates within the cylinder bore 105*c* according to changes in the control pressure Pc. More specifically, when the control pressure PC becomes larger than the urging force of the suction pressure Ps and the spring 141, the piston 132 shifts toward the fully operating position, while when the control pressure Pc becomes smaller than the urging force, the piston 132 shifts toward the partially operating position.

At the start of the compressor, when the control pressure Pc is low and equal to the suction pressure Ps, the piston 132 is in its partially operating position as shown in FIG. 1, so that the rotary plate is also on a partially operating position side, whereby the compressor is operated in the minimum delivery quantity condition.

When the suction pressure Ps becomes higher than a predetermined value, a pressure control valve device, not shown, operates to increase the control pressure Pc within the high-pressure chamber 140, whereby the piston 132 is shifted from its partially operating position toward its fully operating position (rightward as viewed in FIG. 1). Force produced by this linear movement of the piston 132 is transmitted to the rotary plate via the link pin 131 for rotation of the rotary plate from the partially operating position side toward the fully operating position side, whereby the delivery quantity of the compressor is increased.

On the other hand, when the suction pressure Ps becomes lower than the predetermined value, the pressure control valve device operates to decrease the control pressure Pc within the high-pressure chamber 140, whereby the piston 132 is shifted from the fully operating position to the partially operating position (leftward as viewed in FIG. 1). This linear movement of the piston 132 causes the rotary plate to rotate from its fully operating position side toward its partially operating position side, whereby the delivery quantity of the compressor is decreased.

As described above, the delivery quantity of the compressor is continuously and variably controlled by rotation of the rotary plate.

However, in the vane compressor in which compressed refrigerant gas is used to reliably or positively project out each vane, if the compressor is started when the capacity or delivery quantity thereof is small, refrigerant gas cannot be compressed sufficiently, which results in degraded startability of the compressor.

To eliminate such inconvenience, a method has been proposed in which the minimum delivery quantity of a compressor is increased so as to ensure reliable projection of each vane and thereby enhance the startability of the compressor.

In this method, however, since the range of variable capacity of the compressor is reduced due to the increase of the minimum delivery quantity of the same, the compressor is not capable of reducing the delivery quantity thereof to a sufficiently low level as in the case of the proposed variable capacity vane compressor described above. As a result, it is required to switch the compressor on and off frequently.

To overcome this problem, another method has been proposed in which a main spring (stiffer spring) is provided on one side of the piston, for urging the piston toward the partially operating position thereof, while an auxiliary spring (softer spring) is provided on the other side of the piston, for urging the piston toward the fully operating position thereof, so as to make it possible to start the compressor by the use of difference in urging force between the two springs even when the delivery quantity of the compressor is small, thereby ensuring reliable projection of each vane and enhancing the startability of the compressor. According to this method, the compressor can have a wide range of variable capacity during operation thereof, so that the delivery quantity of the compressor can be decreased to the same level as in the proposed variable capacity vane compressor.

However, it is not a balance between the two springs that makes the minimum delivery quantity during operation of a compressor smaller than delivery quantity at the start of the compressor. Actually, the minimum delivery quantity becomes smaller due to drag of the rotor which acts on the rotary plate to limit the movement of the same.

Therefore, this method is not capable of reliably increasing delivery quantity at the start of the compressor, and reducing the minimum delivery quantity during operation of the same.

SUMMARY OF THE INVENTION

It is an object of the invention to provide a variable capacity vane compressor having a construction which is capable of ensuring a wide range of variable capacity by positively increasing the delivery quantity of the compressor at the start of the same and reducing the minimum delivery quantity to a lower level than the delivery quantity at the start of the compressor.

To attain the above object, the present invention provides a variable capacity vane compressor comprising:

a cylinder block;

a rotor rotatably received in the cylinder block;

a plurality of vanes each of which is radially slidably fitted in a corresponding vane slit formed in the rotor;

two side members secured to opposite end faces of the cylinder block, respectively;

a rotary plate mounted in one of the side members, for adjusting compression starting timing to thereby increase or decrease capacity of the compressor;

a main piston slidably mounted in the one of the side members, for causing rotation of the rotary plate between a maximum capacity position and a minimum capacity position;

a pilot piston slidably arranged at one end of the main piston, for inhibiting movement of the main piston in a capacity-decreasing direction;

a first low-pressure chamber formed within another end portion of the main piston, into which suction pressure is introduced via a first low-pressure communication passage;

a high-pressure chamber defined by a reduced-diameter portion formed on the one end of the main piston and one end face of the pilot piston, into which is introduced control pressure for driving the main piston and the pilot piston;

a second low-pressure chamber formed at another end of the pilot piston, into which suction pressure is introduced via a second low-pressure communication passage;

a main urging member urging the main piston in the capacity-decreasing direction; and an auxiliary urging member urging the main piston in a capacity-increasing direction by way of the pilot piston, wherein the second low-pressure communication passage has a cross-sectional area which is smaller than a cross-sectional area of the first low-pressure communication passage.

According to the variable capacity vane compressor of the invention, when the compressor is started, control pressure within the high-pressure chamber is increased, whereby the main piston undergoes a force acting in a capacity-increasing direction, while the pilot piston undergoes a force acting in a capacity-decreasing direction. As a result, the two pistons are urged in opposite directions. However the cross-sectional area of the second low-pressure communication passage is smaller than that of the first low-pressure communication passage, so that refrigerant gas does not readily flow out of the second low-pressure chamber. Therefore, while the main piston can move in response to a slight increase in the control pressure within the high-pressure chamber, the pilot piston cannot move in response to this slight increase in the control pressure.

The pilot piston is shifted in the capacity-decreasing direction from its initial position in which it was at the start of the compressor only when the control pressure within the high-pressure chamber reaches a predetermined value after the compressor is started. The pilot piston shifted to an extreme position thereof in the capacity-decreasing direction is held in this position until the compressor stops operating. On the other hand, the main piston moves in the capacity-increasing direction or the capacity-decreasing direction after the start of the compressor, according to changes in the control pressure within the high-pressure chamber. During the operation of the main piston, the pilot piston stays in its extreme position in the capacity-decreasing direction as described above, so that the range of stroke of the main piston is extended in the capacity-decreasing direction and becomes wider than it was at the start of the compressor.

Therefore, according to the variable capacity vane compressor of the invention, it is possible to positively make the delivery quantity at the start of the compressor larger than the minimum delivery quantity during operation of the compressor, and at the same time, ensure a wide range of variable capacity of the compressor by making the minimum delivery quantity during operation of the compressor smaller than the delivery quantity at the start of the compressor, so that frequency of switching of the compressor between its on-state and off-state can be reduced.

Preferably, the one end face of the pilot piston has an area which is larger than an area of one end face of the main piston opposed to the one end face of the pilot piston.

According this preferred, when the control pressure within the high-pressure chamber reaches a predetermined value after the compressor is started, the pilot piston shifts in the capacity-decreasing direction from the starting position, where it receives the control pressure with its larger area, so that it is urged in the capacity-decreasing direction by the larger force. As a result, the pilot piston is reliably held in the shifted position during operation of the main piston, whereby the stroke length of the main piston is expanded to the capacity-decreasing direction.

More preferably, a ratio between the cross-sectional area of the second low-pressure communication passage and the cross-sectional area of the first low-pressure communication passage is determined based on a ratio between the area of the one end face of the pilot piston and the area of the one end face of the main piston opposed to the one end face of the pilot piston.

According to this preferred embodiment, it is possible to properly control the operation of the pilot piston especially at the start of the compressor.

Preferably, the main urging member and the auxiliary urging member create urging forces equal in strength.

Preferably, the variable capacity vane compressor includes a suction chamber into which refrigerant is drawn, a delivery space into which compressed refrigerant is delivered, a high-pressure introducing passage communicating between the delivery space and the high-pressure chamber to thereby introduce the control pressure into the high-pressure chamber, a third low-pressure chamber into which low-pressure is introduced from the suction chamber, a communication passage communicating between the third low-pressure chamber and the high-pressure chamber-introducing passage, and a pressure control valve arranged in the communication passage for opening and closing the communication passage in response to pressure of the refrigerant drawn into the suction chamber to thereby control the control pressure within the high-pressure chamber.

Preferably, the one of the side members is formed therein with a cylinder bore which is divided into two portions, the first low-pressure chamber being formed in the one of the two portions into which the one end of the main piston is slidably inserted, the high-pressure chamber and the second low-pressure chamber are formed in the another of the two portions into which the another end of the piston is slidably inserted.

The above and other objects, features and advantages of the present invention will become more apparent from the following detailed description taken in conjunction with the accompanying drawings.

DETAILED DESCRIPTION OF THE PREFERRED EMBODIMENT

Next, the invention will now be described in detail with reference to drawings showing a preferred embodiment thereof.

Figure 1:
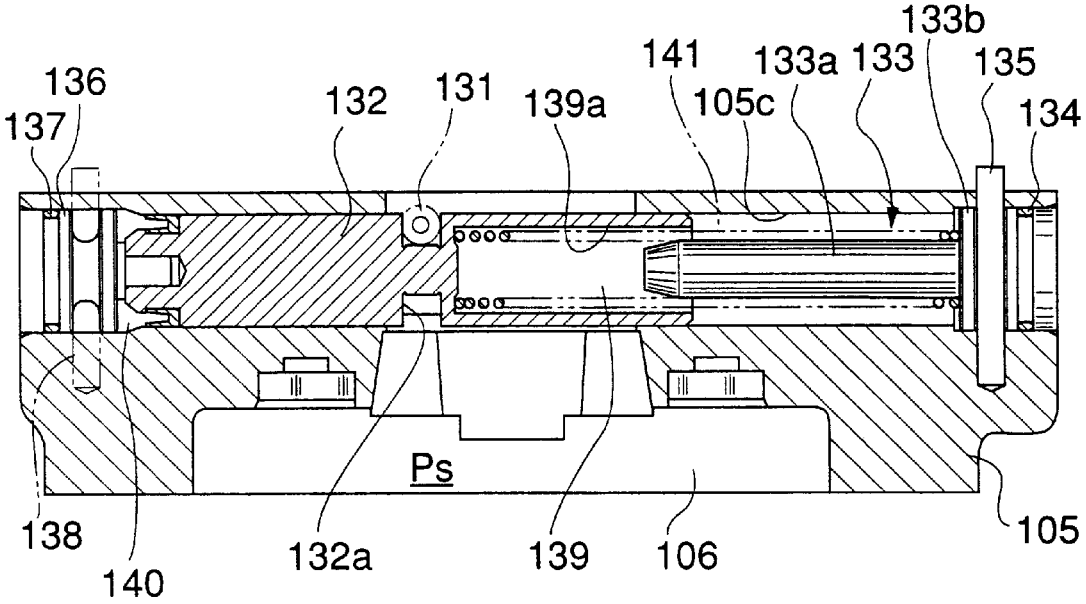
FIG.1 PRIOR ART
FIG. 1 is a longitudinal cross-sectional view showing a piston of a conventional variable capacity vane compressor.
Figure 2:
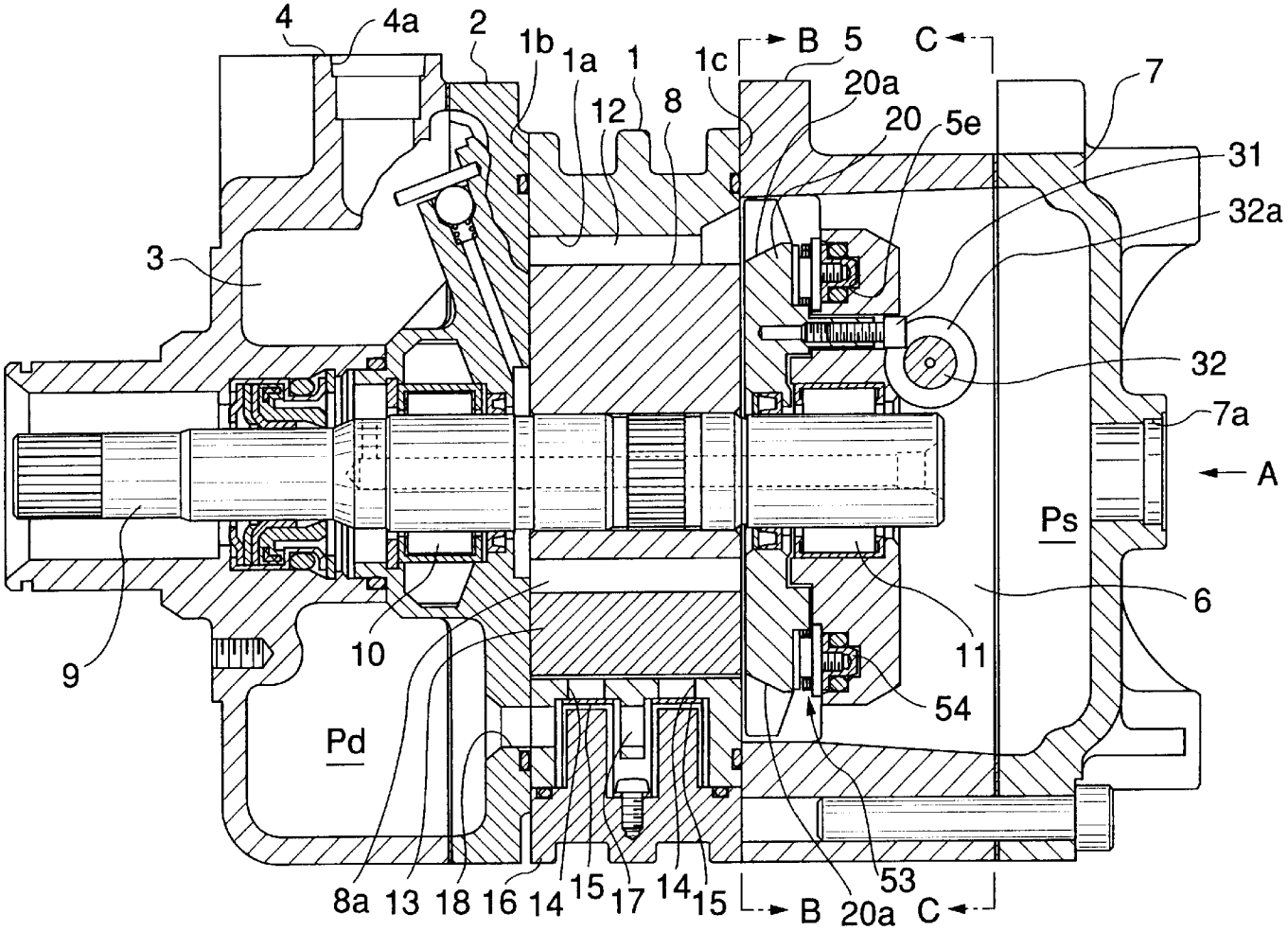
FIG. 2 is a longitudinal cross-sectional view showing the whole arrangement of a variable capacity vane compressor according to an embodiment of the invention.

Referring first to FIG. 2, there is shown the whole arrangement of a variable capacity vane compressor according to an embodiment of the invention.

The variable capacity vane compressor includes a cylinder block 1, a front side block 2 secured to a front end face 1*b* of the cylinder block 1, a front head 4 secured to a front end face of the front side block 2 such that an inner wall of the front head 4 and the front end face of the front side block 2 define a discharge chamber 3, a rear side block 5 secured to a rear end face 1*e* of the cylinder block 1, a rear head 7 secured to a rear end face of the rear side block 5 such that an inner wall of the rear head 7 and an inner peripheral wall of the rear side block 5 define a suction chamber 6, a rotor 8 rotatably received in the cylinder block 1, and a drive shaft 9 on which is rigidly fitted the rotor 8. The drive shaft 9 is rotatable supported by a pair of radial bearings 10 and 11 arranged in the front side block 2 and the rear side block 5, respectively. The rear side block 5 and the rear head 7 form one side member, while the front side block 2 and the front head 4 form another side member.

The front head 4 is formed with a discharge port 4*a* via which refrigerant gas is discharged, while the rear head 6 is formed with a suction port 7*a* via which refrigerant gas is drawn into the compressor. The discharge port 4*a* communicates with the discharge chamber 3. On the other hand, the suction port 7*a* communicates with the suction chamber 6.

A pair of compression chambers 12 are defined at diametrically opposite locations between an inner peripheral surface 1*a* of the cylinder block 1 and an outer peripheral surface of the rotor 8. The rotor 8 has its outer peripheral surface formed with a plurality of axial vane slits 8*a* at circumferentially equal intervals, in each of which a vane 13 is radially slidably fitted.

As shown in FIG. 2, two pairs of refrigerant outlet ports 14 are formed through opposite lateral side walls of the cylinder block 1 in a fashion corresponding to the pair of compression chambers 12 (only one pair of the refrigerant outlet ports 14 are shown in FIG. 2). Each discharge valve 15 is provided for opening and closing a corresponding one of the refrigerant outlet ports 14. Further, between each of the lateral side walls of the cylinder block 1 and a discharge valve cover 16 fixed on the lateral side wall of the cylinder block 1, there is defined a discharge space 17 into which refrigerant gas flows via the respective refrigerant outlet ports 14. The discharge space 17 communicates with the discharge chamber 3 via a refrigerant outlet passage 18 formed through the front side block 2.

Figure 6:
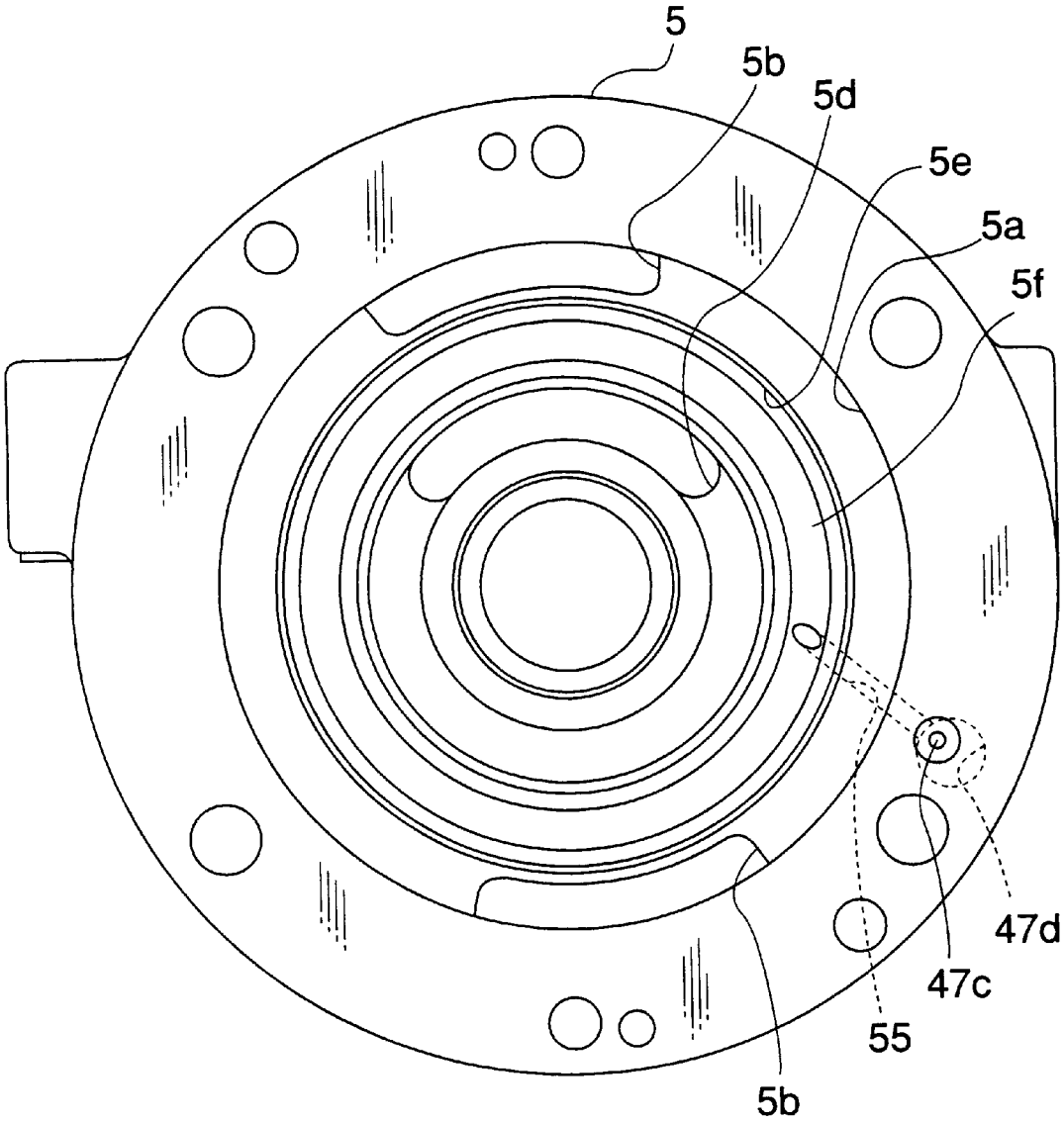
FIG. 6 is an end view of a rear side block of the FIGS. 2 compressor, taken on line B—B of FIG. 2.
Figure 7:
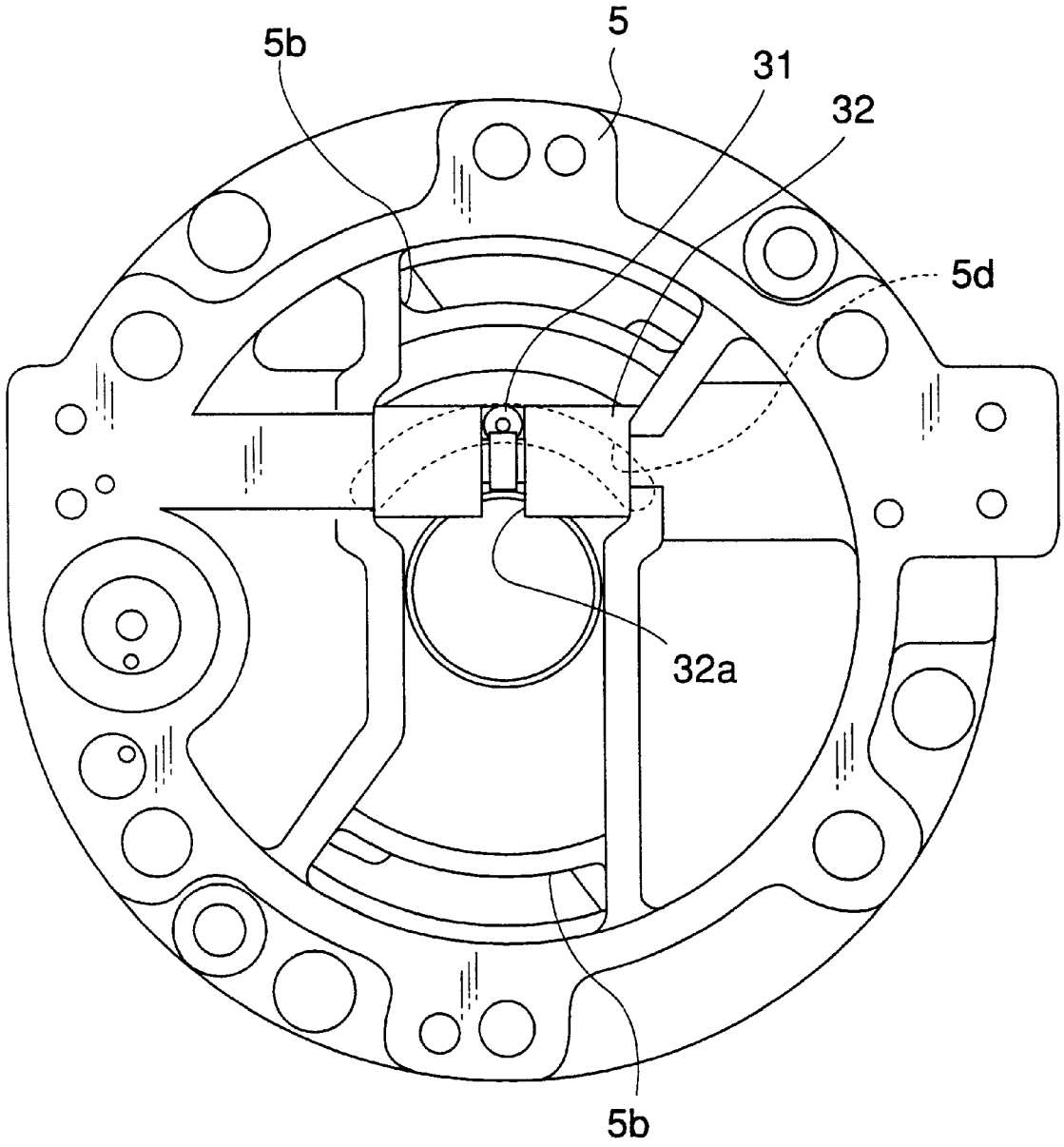
FIG. 7 is a view taken on line C—C of FIG. 2, which shows a condition in which the piston is in a partially operating position.
Figure 8:
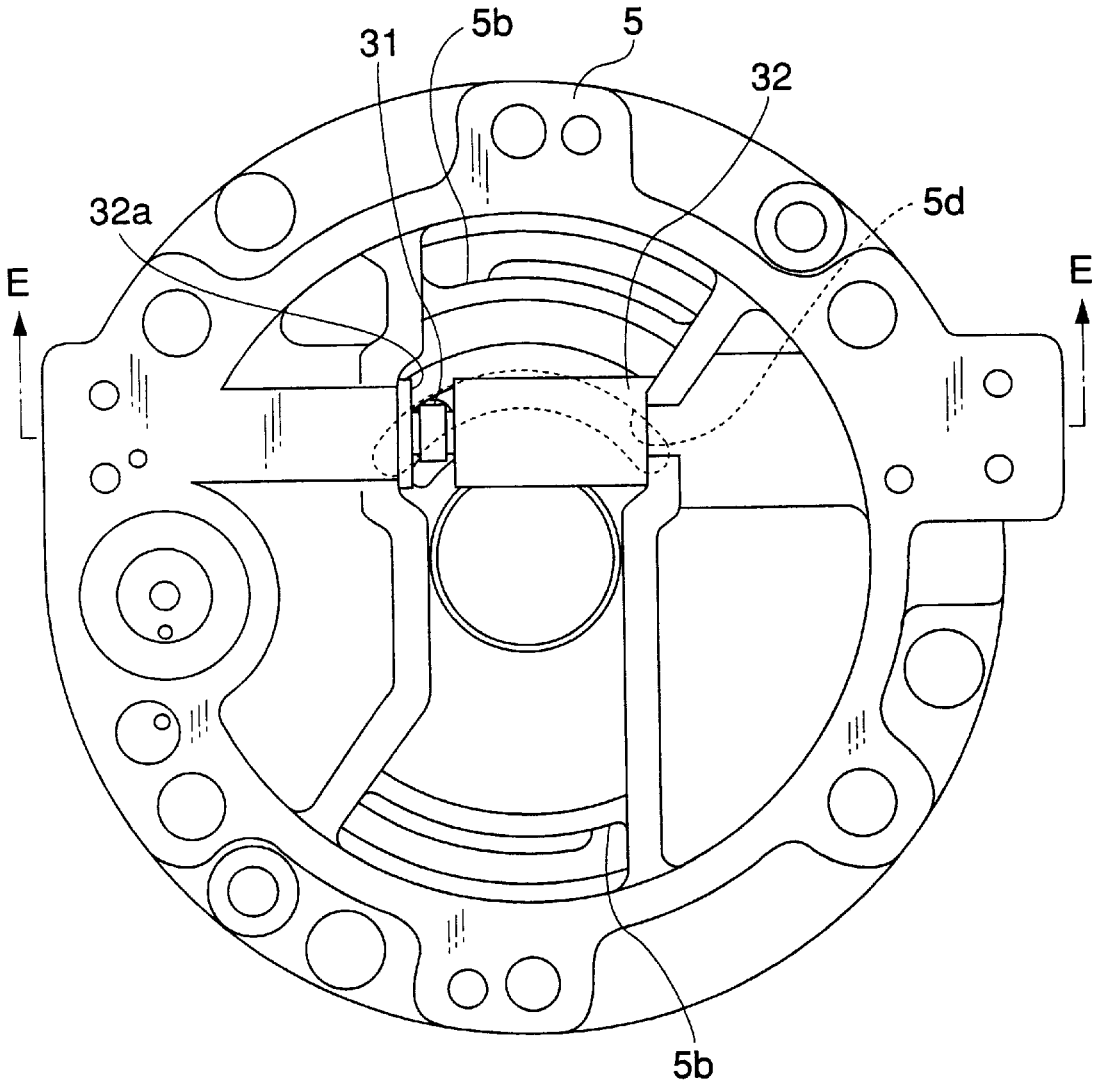
FIG. 8 is a view taken on line C—C of FIG. 2, which shows a condition in which the piston is in an intermediate position between the partially operating position and a fully operating position.

FIG. 6 is an end view of the rear side block, taken on line B—B of FIG. 2, while FIGS. 7 and 8 are views of the same, taken on line C—C of FIG. 2.

As shown in FIG. 6, the rear side block 5 has a cylinder block-side end face formed with an annular recess 5*a* in which is received a rotary plate 20. The rotary plate 20 rotates in a normal or reverse direction as a main piston 32 of a drive mechanism, referred to hereinafter, reciprocates.

The rear side block 5 is formed with two refrigerant inlet holes 5*b* arranged at substantially diametrically opposite locations. The rotary plate 20 is formed with two cut-away portions 20*a* which are cut away from an outer periphery of the rotary plate 20 at substantially diametrically opposite locations. Refrigerant gas within the suction chamber 6 is drawn into the respective compression chambers 12 within the cylinder block 1 via the respective refrigerant inlet holes 5*b* formed through the rear side block 5 and the respective cut-away portions 20*a* of the rotary plate 20.

The rotary plate 20 received in the annular recess 5*a* can rotate between a partially operating position for minimizing the delivery quantity of the compressor by delaying to a delaying limit the termination of each suction process (or the start of each compression process) for drawing refrigerant gas via the respective refrigerant inlet holes 5*b* and cut-away portions 20*a* and a fully operating position for maximizing the delivery quantity of the compressor by advancing to an advancing limit the termination of a suction process, to thereby continuously change the delivery quantity of the compressor.

Figure 3:
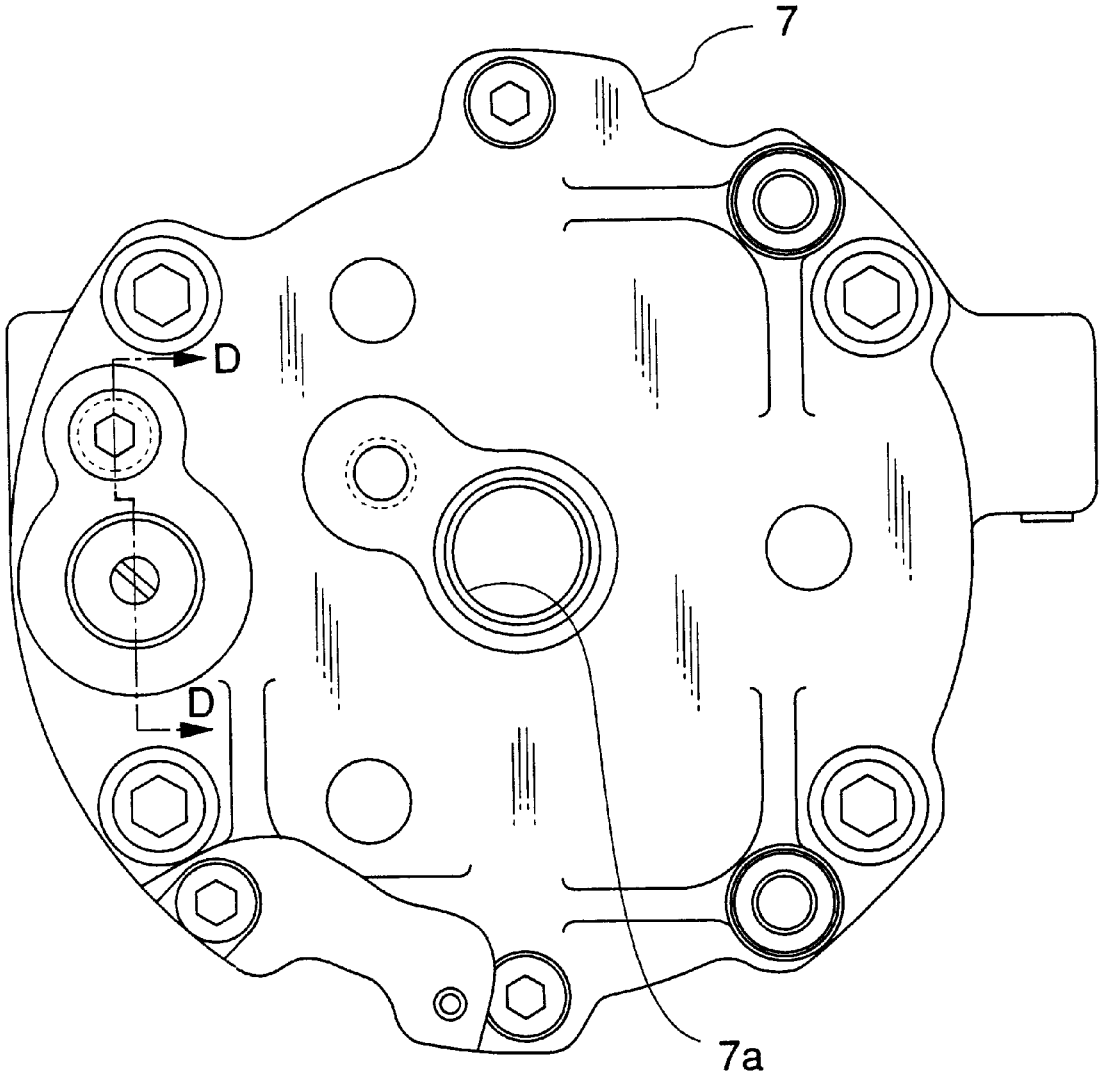
FIG. 3 is an end view of the FIG. 2 compressor, taken from an arrow A in FIG. 2.

FIG. 3 is a view taken an line A—A of FIG. 2.

Figure 4:
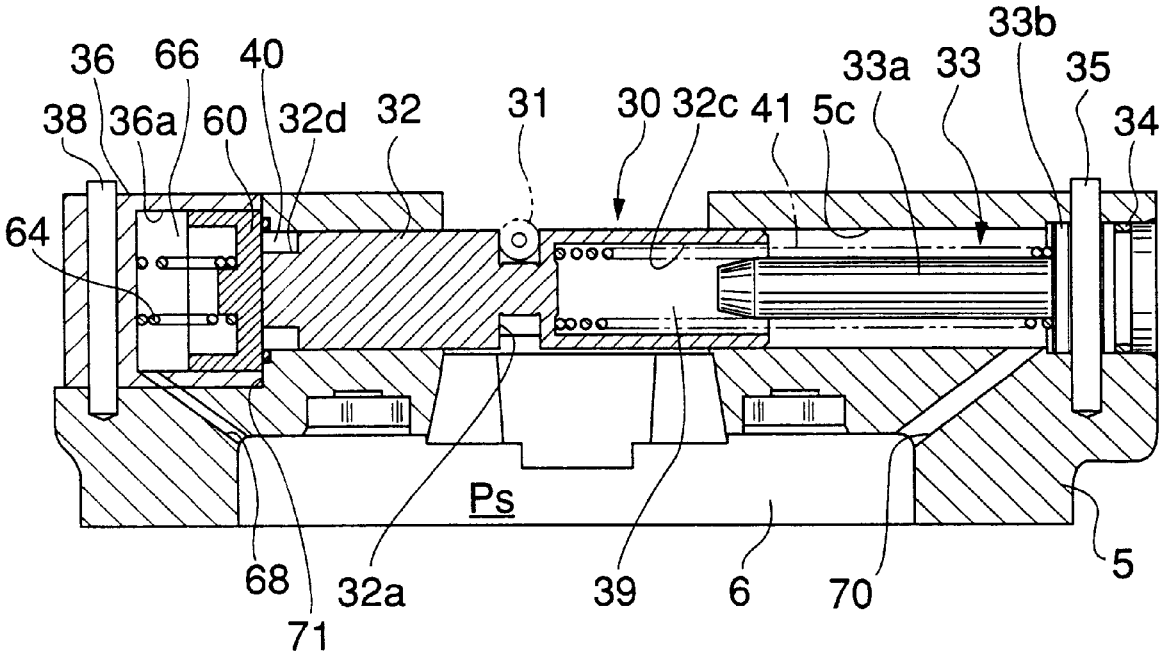
FIG. 4 is a cross-sectional view taken on line E—E of FIG. 8.
Figure 5:
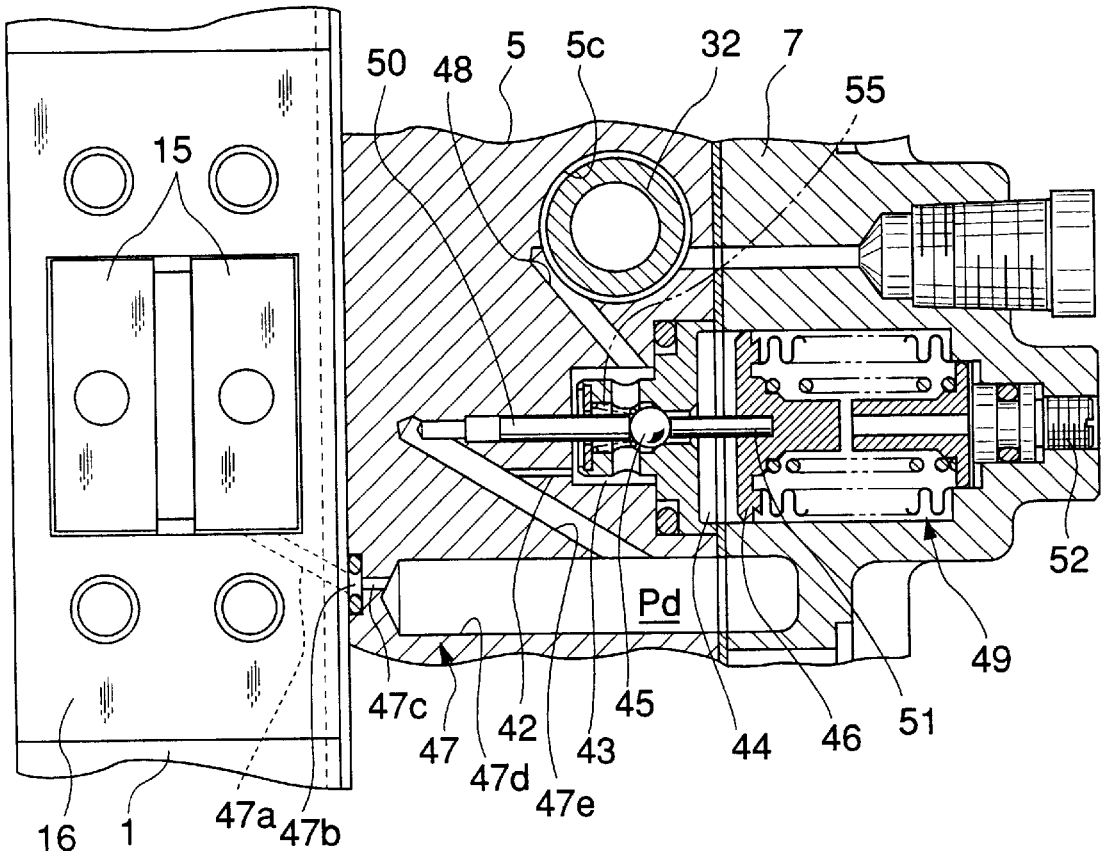
FIG. 5 is a cross-sectional view taken on line D—D of FIG. 3.

FIG. 4 is a cross-sectional view taken on line E—E of FIG. 8, while FIG. 5 is a cross-sectional view taken on line D—D of FIG. 3.

The drive mechanism includes the main piston 32 which causes rotation of the rotary plate 20 via a link pin 31 (see FIG. 2) fixed to the rotary plate 20, and a pressure control valve device 49 for controlling reciprocation of the main piston 32.

The main piston 32 is slidably received within a cylinder bore 5*c* formed in the rear side block 5. The link pin 31, which is protruded toward the rear side of the compressor, has an end thereof partially fitted in an annular groove 32*a* formed on a peripheral surface of the main piston 32, and partially fitted in an arcuate guide groove 5*d* formed in the rear side block 5, in a manner slidable along the guide groove 5*d* (see FIG. 7). As the main piston 32 reciprocates within the cylinder bore 5*c*, the end of the link pin 31 slides along the arcuate guide groove 5*d* for rotation of the rotary plate 20.

As shown in FIG. 4, a spring guide member 33 having a rod-shaped spring guide portion 33*a* is inserted into one end of the cylinder bore 5*c*. The one end of the cylinder bore 5*c* is closed tightly by a spring seat 33*b* of the spring guide member 33 and an O ring 34. The spring seat 33*b* is fixed to the rear side block 5 by a pin 35. The other end of the cylinder bore 5*c* is closed tightly by a spring seat 36. The spring seat 36 is fixed to the rear side block 5 by a pin 38. The spring seat 36 is formed with a bore 36*a* in which is received a pilot piston 60 in a manner slidable in the direction of movement of the main piston 32. The bore 36*a* has a cross-sectional area which is larger than that of the cylinder bore 5*c*. An auxiliary spring (auxiliary urging member) 64 is mounted between a bottom surface of the bore 36*a* and the main piston 32. The bore 36*a* of the spring seat 36 and the pilot piston 60 defines a second low-pressure chamber 66, which communicates with the suction chamber 6 via a restriction passage (second low-pressure communication passage) 68. A main piston-side end face of the pilot piston 60 has an area substantially three times as large as that of a pilot piston-side end face of the main piston 32.

The main piston 32 has the guide member-side end face thereof formed with a bore 32*c* which define therein a first low-pressure chamber 39. A main spring (main urging member) 41 is mounted between a bottom surface of the bore 32*c* and the spring seat 33*b*. The main spring 41 and the auxiliary spring 64 create urging forces equal in strength. The first low-pressure chamber 39 communicates with the suction chamber 6 via a low-pressure communication passage (first low-pressure communication passage) 70. The low-pressure communication passage 70 has a cross-sectional area which is larger than that of the restriction passage 68. The ratio of the cross-sectional area of the restriction passage 68 to the cross-sectional area of the low-pressure communication passage 70 is determined based on the ratio of the area of the main piston-side end face of the pilot piston 60 to that of the pilot piston-side end face of the main piston 32.

A high-pressure chamber 40 is defined by a reduced-diameter portion 32*d* formed on the pilot piston-side end of the main piston 32 and the main piston-side end face of the pilot piston 60. Control pressure Pc, referred to hereinafter, is introduced into the high-pressure chamber 40 via a communication passage 48 (see FIG. 5).

The main piston 32 is urged in the capacity-decreasing direction (leftward as viewed in FIG. 4) for decreasing the delivery quantity of the compressor, by the sum of urging force of the main spring 41 and suction pressure Ps within the first low-pressure chamber 39, and at the same time, urged in the capacity-increasing direction (rightward as viewed in FIG. 4) for increasing the delivery quantity of the compressor, by the sum of the control pressure Pc within the high-pressure chamber 40, the urging force of the auxiliary spring 64, and the suction pressure Ps within the second low-pressure chamber 66. The main piston 32 moves within the cylinder bore 5*c* according to changes in the control pressure Pc. On the other hand, the pilot piston 60 is urged in the capacity-increasing direction (rightward as viewed in FIG. 4) by the sum of urging force of the auxiliary spring 64 and the suction pressure Ps within the second low-pressure chamber 66, and at the same time, urged in the capacity-decreasing direction (leftward as viewed in FIG. 4) by the sum of the control pressure Pc within the high-pressure chamber 40, the urging force of the main spring 41, and the suction pressure Ps within the first low-pressure chamber 39.

The pressure control valve device 49, which changes the control pressure Pc to be introduced into the high-pressure chamber 40, according to changes in the suction pressure Ps within the suction chamber 6, includes a ball valve 45 for opening and closing a communication passage between a control pressure chamber 43 and a bellows chamber 44, a spring 55 urging the ball valve 45 in the valve-closing direction, a plunger 50 via which discharge pressure Pd introduced through a high pressure-introducing passage 47 urges the ball valve 45 in a valve-closing direction, a bellows 46 which is received in the bellows chamber 44 into which the suction pressure Ps is introduced from the suction chamber 6, and extends and contracts according to changes in the suction pressure Ps, and a rod 51 secured to a free end of the bellows 46, for urging the ball valve 45 in a valve-opening direction when the bellows 46 extends.

The high pressure-introducing passage 47 includes a communication passage 47*a* formed within the cylinder block 1, and a port 47*b*, a communication passage 47*c*, a discharge pressure-introducing chamber 47*d* large in capacity, and a communication passage 47*e*, each formed within the rear side block 5. The communication passage 47*a* communicates with the discharge space 17 (see FIG. 2) into which flows refrigerant gas delivered from the compression chambers 12. The communication passage 47*e* communicates with the control pressure chamber 43 via an orifice 42. The refrigerant gas delivered from the compression chambers 12 is introduced into the control pressure chamber 43 via the orifice 42 to produce control pressure Pc.

Further, the control pressure chamber 43 communicates with the high-pressure chamber 40 via the communication passage 48 for introducing the control pressure Pc produced within the control pressure chamber 43 into the high-pressure chamber 40.

When the suction pressure Ps becomes lower than a predetermined value, the bellows 46 extends from the state shown in FIG. 5 to open the ball valve 45, whereby the control pressure Pc within the control pressure chamber 43 and the high-pressure chamber 40 is lowered. On the other hand, when the suction pressure Ps becomes higher than the predetermined value, the bellows 46 contracts as shown in FIG. 5 to close the ball valve 45, whereby the control pressure Pc within the control pressure chamber 43 and the high-pressure chamber 40 is increased. The predetermined value can be adjusted by an adjusting screw 52.

Within an annular recess 5*e* formed in a bottom surface of the annular recess 5*a* formed in the rear side block 5, there is received an annular piston 54 in a manner abutting on a rear end face 20*b* of the rotary plate 20 via a thrust bearing 53.

Next, the operation of the variable capacity vane compressor constructed as above will be explained.

Before the compressor is started, the main piston 32 and the pilot piston 60 are placed in such a state as shown in FIG. 4 since the urging force of the main spring 41 and that of the auxiliary spring 64 are held in equilibrium. In other words, since the control pressure Pc is equal to the suction pressure Ps before the start of the compressor, the main piston 32 is placed in a position in which it should be when the urging force of the main spring 41 and that of the auxiliary spring 64 are balanced. At this time point, the main piston 32 is in a position slightly away from the partially operating position, referred to hereinafter, toward the fully operating position, referred to hereinafter, so that the delivery quantity at the start of the compressor is slightly larger than it is when the main piston 32 is in the partially operating position. Therefore, compressed refrigerant gas of relatively high pressure can be supplied to each vane slit 8*a*, which ensures reliable projection of each vane 13, thereby enhancing startability of the compressor.

After the start of the compressor, only when the control pressure Pc within the high-pressure chamber 40 is increased and reaches the predetermined value, the pilot piston 60 start to progressively move in the capacity-decreasing direction from its position at the start of its operation, and finally abuts on the bottom surface of the spring seat 36. The pilot piston 60 is held in this position until the compressor stops its operation. When the pilot piston 60 is shifted in the capacity-decreasing direction, the main piston-side end face of the pilot piston 60 moves away from an abutment surface 71 of the rear side block 5, so that a high pressure-receiving area of the pilot piston 60 becomes larger than it was at the start of the compressor. On the other hand, the main piston 32 moves in the capacity-increasing direction or the capacity-decreasing direction according to changes in the control pressure Pc. During the operation of the main piston 32, the pilot piston 60 stays abutting on the bottom surface of the spring seat 36, and hence the range of stroke of the main piston 32 is extended in the capacity-decreasing direction.

When the suction pressure Ps exceeds the predetermined value during the operation of the compressor, the pressure control valve device 49 operates to increase the control pressure PC within the high-pressure chamber 40, whereby the main piston 32 is shifted from the partially operating position (where the main piston 32 abuts on the pilot piston 60 which stays abutting on the bottom surface of the spring seat 36) toward the fully operating position (where the bottom surface of the bore 32*c* formed in the main piston 32 abuts on the end of the guide portion 33*a*) (i.e. rightward as viewed in FIG. 4). This linear movement of the main piston 32 is transmitted to the rotary plate 20 via the link pin 31 to cause rotation of the rotary plate 20 from the partially operating position (position for delaying the start of compression to the delaying limit) side to the fully operating position (position for advancing the start of compression to the advancing limit) side, whereby the delivery quantity of the compressor is increased.

When the suction pressure Ps becomes lower than the predetermined value, the pressure control valve device operates to decrease the control pressure Pc within the high-pressure chamber 40, whereby the main piston 32 is shifted in the capacity-decreasing direction (leftward as viewed in FIG. 4). This linear movement of the main piston 32 is transmitted to the rotary plate 20 via the link pin 31 to cause rotation of the rotary plate 20 from the fully operating position side to the partially operating position side, whereby the delivery quantity of the compressor is decreased. At this time point, the pilot piston 60 has already been shifted by the control pressure Pc in the capacity-decreasing direction (leftward as viewed in FIG. 4) against the force urging the same in the capacity-increasing direction (rightward as viewed in FIG. 4). Therefore, the main piston 32 can shift further leftward from its initial position (shown in FIG. 4) to thereby make the delivery quantity smaller than it was at the start of the compressor, whereby the variability of capacity of the compressor is enhanced.

When the compressor stops its operation, the control pressure Pc and the suction pressure Ps within the compressor are brought into equilibrium, i.e. Pc=Ps holds, so that the force urging the pilot piston 60 leftward as viewed in FIG. 4 is canceled, and hence the pilot piston 60 returns to its initial position as viewed in FIG. 4.

According to the variable capacity vane compressor of the embodiment, since drag of the rotor 2 is not used to control the rotary plate 20, it is possible to positively make the delivery quantity at the start of the compressor larger than the minimum delivery quantity during operation of the compressor, and at the same time, ensure a wide range of variable capacity of the compressor by making the minimum delivery quantity during operation of the compressor smaller than the delivery quantity at the start of the compressor, so that frequency of switching of the compressor between energization and deenergization can be reduced.

It is further understood by those skilled in the art that the foregoing is the preferred embodiment of the invention, and that various changes and modification may be made thereto without departing from the spirit and scope thereof.

What is claimed is:

1. A variable capacity vane compressor comprising:

a cylinder block;

a rotor rotatably received in said cylinder block;

a plurality of vanes each of which is radially slidably fitted in a corresponding vane slit formed in said rotor;

two side members secured to opposite end faces of said cylinder block, respectively;

a rotary plate mounted in one of said side members, for adjusting compression starting timing to thereby increase or decrease capacity of said compressor;

a main piston slidably mounted in said one of said side members, for causing rotation of said rotary plate between a maximum capacity position and a minimum capacity position;

a pilot piston slidably arranged at one end of said main piston, for inhibiting movement of said main piston in a capacity-decreasing direction;

a first low-pressure chamber formed within another end portion of said main piston, into which suction pressure is introduced via a first low-pressure communication passage;

a high-pressure chamber defined by a reduced-diameter portion formed on said one end of said main piston and one end face of said pilot piston, into which is introduced control pressure for driving said main piston and said pilot piston:

a second low-pressure chamber formed at another end of said pilot piston, into which suction pressure is introduced via a second low-pressure communication passage;

a main urging member urging said main piston in said capacity-decreasing direction; and an auxiliary urging member urging said main piston in a capacity-increasing direction by way of said pilot piston, wherein said second low-pressure communication passage has a cross-sectional area which is smaller than a cross-sectional area of said first low-pressure communication passage.

2. A variable capacity vane compressor according to claim 1, wherein said one end face of said pilot piston has an area which is larger than an area of one end face of said main piston opposed to said one end face of said pilot piston.

3. A variable capacity vane compressor according to claim 2, wherein a ratio between said cross-sectional area of said second low-pressure communication passage and said cross-sectional area of said first low-pressure communication passage is determined based on a ratio between said area of said one end fade of said pilot piston and said area of said one end face of said main piston opposed to said one end face of said pilot piston.

4. A variable capacity vane compressor according to claim 1, wherein said main urging member and said auxiliary urging member create urging forces equal in strength.

5. A variable capacity vane compressor according to claim 2, wherein said main urging member and said auxiliary urging member create urging forces equal in strength.

6. A variable capacity vane compressor according to claim 1, including a suction chamber into which refrigerant is drawn, a delivery space into which compressed refrigerant is delivered, a high-pressure introducing passage communicating between said delivery space and said high-pressure chamber to thereby introduce said control pressure into said high-pressure chamber, a third low-pressure chamber into which low-pressure is introduced from said suction chamber, a communication passage communicating between said third low-pressure chamber and said high-pressure chamber-introducing passage, and a pressure control valve arranged in said communication passage for opening and closing said communication passage in response to pressure of said refrigerant drawn into said suction chamber to thereby control said control pressure within said high-pressure chamber.

7. A variable capacity vane compressor according to claim 1, wherein said one of said side members is formed therein with a cylinder bore which is divided into two portions, said first low-pressure chamber being formed in said one of said two portions into which said one end of said main piston is slidably inserted, said high-pressure chamber and said second low-pressure chamber are formed in said another of said two portions into which said another end of said piston is slidably inserted.

* * * * *